US010906789B2

(12) United States Patent
Fox

(10) Patent No.: US 10,906,789 B2
(45) Date of Patent: Feb. 2, 2021

(54) POWER UNIT FOR A FLOOR JACK

(71) Applicant: VIS, LLC, Travelers Rest, SC (US)

(72) Inventor: Robert Fox, Greenville, SC (US)

(73) Assignee: VIS, LLC, Travelers Rest, SC (US)

( * ) Notice: Subject to any disclaimer, the term of this patent is extended or adjusted under 35 U.S.C. 154(b) by 167 days.

(21) Appl. No.: 16/158,439

(22) Filed: Oct. 12, 2018

(65) Prior Publication Data

US 2020/0071140 A1 Mar. 5, 2020

Related U.S. Application Data

(60) Provisional application No. 62/727,110, filed on Sep. 5, 2018.

(51) Int. Cl.

| | |
|---|---|
| ***B66F 3/42*** | (2006.01) |
| ***B66F 3/26*** | (2006.01) |
| ***B66F 5/04*** | (2006.01) |

(52) U.S. Cl.

CPC ..... *B66F 3/42* (2013.01); *B66F 3/26* (2013.01); *B66F 5/04* (2013.01)

(58) Field of Classification Search

CPC .... B66F 3/00; B66F 3/24; B66F 3/245; B66F 3/247; B66F 3/25; B66F 3/26; B66F 3/42

See application file for complete search history.

(56) References Cited

U.S. PATENT DOCUMENTS

| | | | | |
|---|---|---|---|---|
| 2,503,659 | A * | 4/1950 | Frank | B66F 3/42 254/93 R |
| 2,548,903 | A * | 4/1951 | Mueller | B66F 3/42 60/458 |
| 3,279,957 | A * | 10/1966 | Fink | C23C 22/62 148/243 |
| 3,404,868 | A | 10/1968 | Belongia et al. | |
| 3,975,986 | A | 8/1976 | Barth et al. | |
| 4,202,514 | A | 5/1980 | Chen | |
| 5,201,494 | A | 4/1993 | Lundman | |
| 2004/0183057 | A1 | 9/2004 | Bruzek | |
| 2006/0137991 | A1 * | 6/2006 | Zschintzsch | C25D 3/58 205/241 |
| 2014/0326934 | A1 | 11/2014 | Zhou | |
| 2015/0123055 | A1 | 5/2015 | Arzourman | |

OTHER PUBLICATIONS

PCT Nternational Search Report and Wriiten Opinion; dated Nov. 26, 2019; 11 Pages.

* cited by examiner

*Primary Examiner* — Tyrone V Hall, Jr.
(74) *Attorney, Agent, or Firm* — J. Bennett Mullinax, LLC

(57) ABSTRACT

A power unit for a hydraulic floor jack is provided having a unitary forged steel manifold engaged with a ram assembly, the ram assembly and manifold being selected from materials and finishes that when interacting with a cylinder bearing, exhibits a longer performance life.

19 Claims, 5 Drawing Sheets

POWER UNIT FOR A FLOOR JACK

RELATED APPLICATIONS

This application claims the benefit of U.S. Application Ser. No. 62/727,110 filed on Sep. 5, 2018 and which is incorporated herein by reference.

FIELD OF THE INVENTION

This invention is directed towards lifting equipment and more specifically a hydraulic floor jack having improvements in the design and operation of the power unit.

BACKGROUND OF THE INVENTION

Floor jacks are well known in the prior art and are frequently used in automotive services to lift a vehicle in order to provide access to the underside of the vehicle or to lift one or more tires off of the floor for service. Floor jacks may also be used to lift other objects. Floor jacks typically include a body frame supported on wheels and are operated by a power unit such as a hydraulic pump/actuator assembly having a manually operated hydraulic pump paired with a hydraulic actuator. The pump is operated by means of a handle which is pumped up and down to produce hydraulic pressure. The actuator portion of the hydraulic assembly includes an actuator rod which extends in response to increased hydraulic pressure in the pump. The typical floor jack includes a lift arm which is pivotally connected to the frame at a first pivot point near its approximate end. A distal end portion of the actuator rod is pivotally connected to the lift arm at a second pivot point all set from the first pivot point but still positioned adjacent to the approximate end of the lift arm. A distal end of the lift arm is connected to a saddle having a surface for engaging the underside of a vehicle or other object to be raised. A pair of stabilizer links forms a parallelogram linkage with the lift arm in order to keep the surface of the saddle in a generally horizontal orientation through out the range of motion of the lift arm.

As the pump handle is moved up and down, the actuator rod extends and the lift arm is pivoted about the first pivot point causing the distal end of the lift arm and the attached saddle to move upwardly. The motion of the lift arm will bring the upper surface of the saddle into contact with the underside of the object to be raised and will eventually raise the object.

The pumping action, movement, and load bearing stresses associated with a hydraulic floor jack exert wear and tear on a number of components. One such component is the power system which utilizes hydraulic pistons and pumps to generate the lifting force. Typically, professional quality hydraulic floor jacks can be expected to have a performance life of about 5000 cycles depending upon the materials and manufacturing quality of the power unit structure. When a hydraulic floor jack becomes unusable, it is invariably as a result of failure of component parts within the power unit. Accordingly, there is room for variation and improvement within the art.

SUMMARY OF THE INVENTION

It is an object of at least one embodiment of the present invention to provide a new and improved hydraulic floor jack power unit.

It is another object of at least one embodiment of the present invention to provide for a new and improved hydraulic pumping system for hydraulic floor jacks.

It is another object of at least one embodiment of the present invention to provide a hydraulic power unit for a floor jack comprising: a forged steel manifold comprising a unitary combination of a manifold, a cylinder welded to the manifold, the cylinder having a 45 steel and a 32 micro finish, an upper surface of the manifold having a plurality of ports for receiving one or more check valves; a ram assembly within a cylinder of the manifold, the ram assembly further provided by a material with an HRC of between about 30 to about 34 and further having a 16 micro-finish, the ram assembly further comprising a ram bearing secured to a first end of the ram, the ram bearing having an external bronze coating, a micro-finish value of 32, and comprising a steel material with a HRC value of between about 28 to about 32, the ram bearing being in contact with a nylon 1010 backup ring, the nylon back up ring being in further communication with a U-cup seal of polyurethane, the U-cup seal having a shore A 95 hardness value.

It is another object of at least one embodiment of the present invention to provide a hydraulic power unit wherein the ram is in communication on a second end with a cylinder bearing, the interior cylinder bearing having a micro-finish of 32.

It is another object of at least one embodiment of the present invention a hydraulic power unit for a floor jack comprising a forged Q235 steel manifold comprising a cylinder and a reservoir; a ram assembly and operative engagement with the cylinder, the ram assembly further comprising a ram bearing secured to a first end of the ram, the ram bearing having a exterior surface comprising a welded bronze coating, the exterior surface having a hardness value of between about 28 to about 32 and a micro finish value of 32.

Optionally, the power unit may further comprise a plurality of ports defined on an upper surface of the manifold, wherein a lower pressure pump housing and a lower pressure pump piston secured therein is in operative engagement and further secured on one of said plurality of manifold ports and wherein a high pressure pump housing and a high pressure pump piston secured therein are in operative engagement and are in further communication with one of said plurality of manifold ports.

It is another object of the invention to provide for a power unit as set forth above wherein an inner surface of the low pressure pump housing has a ball broach finish of 16 micro.

It is another object of the invention to provide for a hydraulic power unit wherein an inner surface of the high pressure pump housing has a ball broach finish of 16 micro.

It is another object of the invention to provide for a power unit wherein an inner surface of the high pressure housing defines a surface having a 16 micro finish value.

It is another object of the invention to provide for a power unit wherein the high pressure housing further includes a black oxide outside coating.

It is another object of the invention to provide for a power unit wherein the low pressure housing further defines a black oxide outside coating.

It is another object of the invention to provide for a power unit wherein a cylinder bearing is used to secure the ram within the manifold cylinder, the manifold cylinder bearing having a HRC value of between about 28 to about 32 and further defining a micro finish of 32.

It is another object of the invention to provide for a power unit wherein the cylinder bearing further defines a groove on an inner surface of the cylinder bearing, the groove including a polyurethane O-ring having a shore A hardness of about 90 the O-ring preventing pressurized hydraulic fluid from flowing pass the cylinder bearing.

It is another object of the invention to provide for a power unit wherein the low pressure pump piston has an HRC value of between about 34 to about 38 and further defines a chrome plated micro finish of about 16.

It is another object of the invention to provide for a power unit wherein the high pressure pump piston has an HRC value of between about 34 to about 38 and further defines a chrome plated micro finish of about 16.

It is another object of the invention to provide for a power unit wherein the plurality of ports includes at least one port in further communication with a pressure release valve.

It is another object of the invention to provide for a power unit wherein the ram bearing further defines a groove on an outer surface of the ram bearing, the groove including a polyurethane U-cup seal and a nylon back up ring, the U-cup seal and nylon backup ring preventing pressurized hydraulic fluid from movement past the ram bearing.

It is another object of the invention to provide for a power unit wherein the low pressure pump piston further defines a groove on an outer surface of the pump piston for lubrication purposes.

It is another object of the invention to provide for a power unit wherein high pressure pump piston further defines a groove on an outer surface of the pump piston for lubrication purposes.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

The power unit for a hydraulic floor jack is complex, involves multiple moving parts and is subject to extensive wear and tear. Even the highest quality professional hydraulic floor jacks have power units that heretofore were expected to provide for a product life of 5,000 cycles. In accordance with the present invention it has been found that the service life of an hydraulic floor jack power unit can be increased in excess of 10,000 cycles. The improvements come about as the result of multiple modifications to provide more robust parts high wear/high stress components within the hydraulic power unit. Collectively it has been found that by modifying key components within the hydraulic power unit; a power unit can be constructed that has a significant improvement in durability and performance life.

Figure 1:
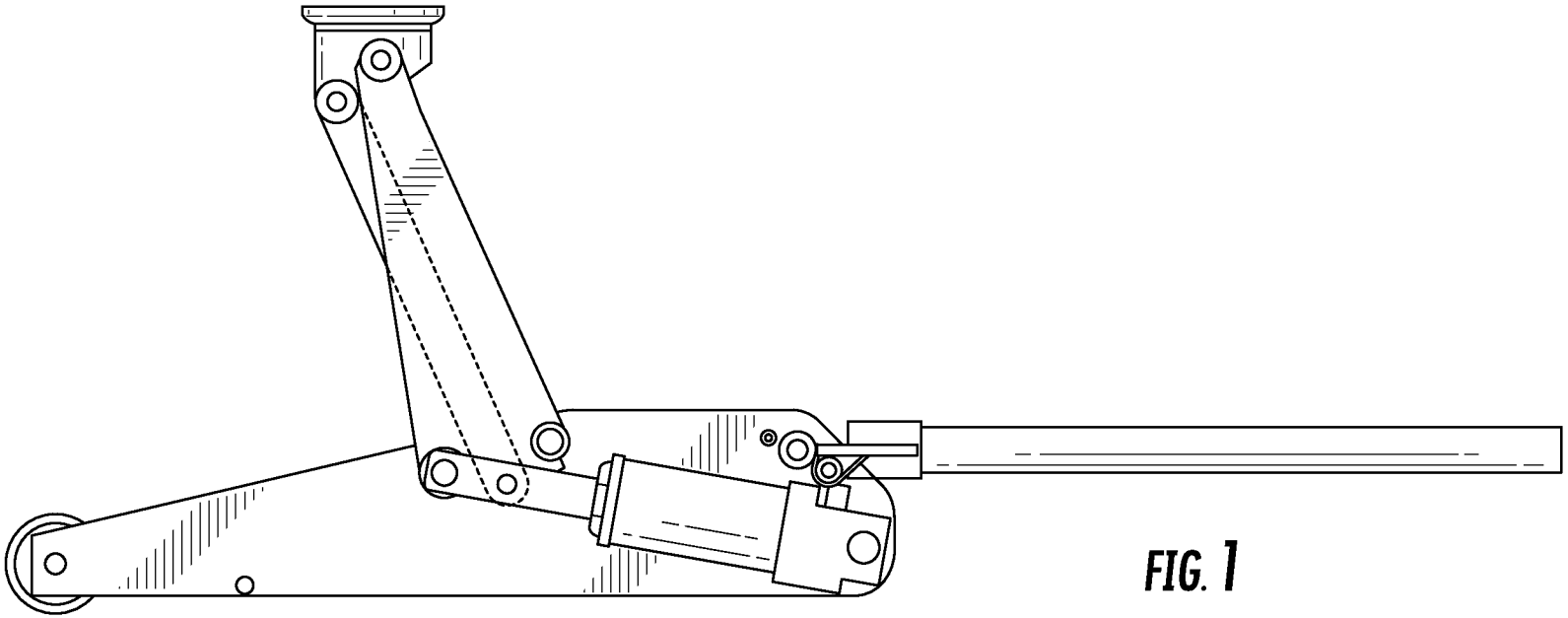
FIG. 1 (PRIOR ART)
FIG. 1 is a partially schematic cross sectional view of a typical prior art hydraulic floor jack in a raised position.
Figure 2:
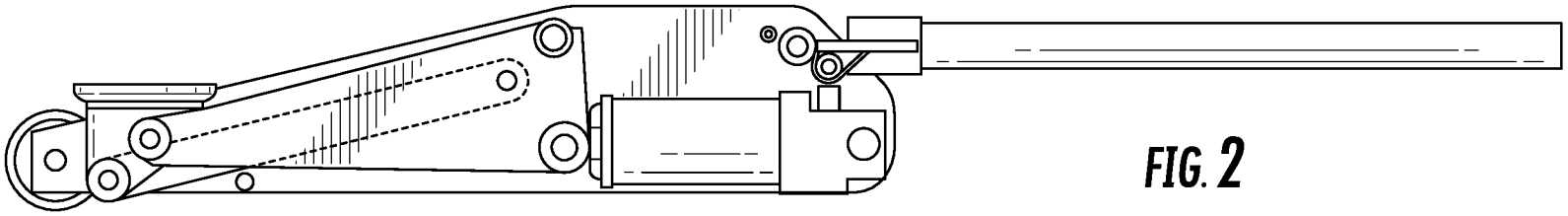
FIG. 2 (PRIOR ART)
FIG. 2 is a view similar to FIG. 1 showing the prior art jack in a lower position.
Figure 3:
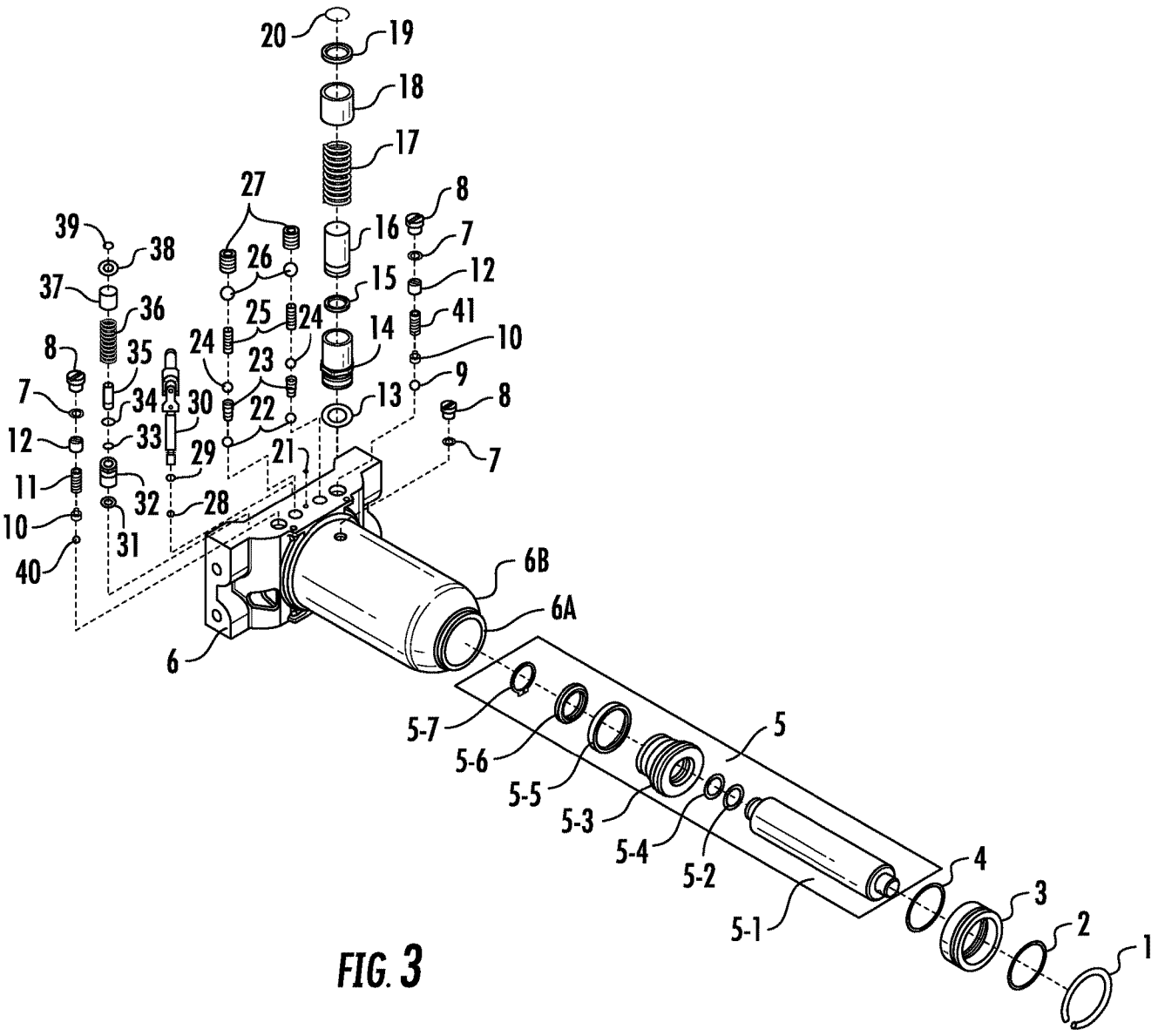
FIG. 3 is an exploded perspective view of the components of a hydraulic floor jack power unit according to an embodiment of the present invention.

Set forth in FIG. 3 is a exploded perspective view of the components of a power unit 100, A parts list corresponding to FIG. 3 is set forth below.

Ref. # Description
1 Retaining Ring
2 Polyurethane O-ring
3 Cylinder Bearing
4 Polyurethane O-ring
5 Ram Assembly
5-1 Ram
5-2 Nylon Backup Ring
5-3 Ram Bearing
5-4 Neoprene O-ring
5-5 Nylon Backup Ring
5-6 Polyurethane U-cup
5-7 Retaining Ring
6 Uni-weld Constructed Manifold
6A Cylinder
6B Reservoir
7 Neoprene O-ring, 3 each
8 Fill Screw 1 each and Cover Screws, 2 each
9 Check Ball
10 Ball Seat, 2 each
11 High Pressure Overload Spring
12 Overload Adjustment Screw, 2 each
13 Copper Sealing Washer (Low Pressure)
14 Low Pressure Pump Housing

15 Polyurethane U-cup (Low Pressure)
16 Low Pressure Pump Piston
17 Pump Compression Spring (Low Pressure)
18 Dust Cover (Low Pressure)
19 Retaining Washer (Low Pressure)
20 Retaining Ring (Low Pressure)
21 Check Ball, Plug
22 Suction Port Check Ball, 2 each
23 Suction Port Spring, 2 each
24 Injection Check Ball, 2 each
25 Injection Port Spring, 2 each
26 Check Ball Seal, 2 each
27 Valve Cover Screw, 2 each
28 Release Valve Check Ball
29 Release Valve Polyurethane O-ring
30 Release Valve Assembly
31 Copper Sealing Washer (High Pressure)
32 High Pressure Pump Housing
33 Polyurethane U-cup (High Pressure)
34 Nylon Backup Ring (High Pressure)
35 High Pressure Pump Piston
36 Pump Compression Spring (High Pressure)
37 Dust Cover (High Pressure)
38 Retaining Washer (High Pressure)
39 Retaining Ring (High Pressure)
40 Check Ball (High Pressure)
41 Low Pressure Overload Spring One of ordinary skill in the art would recognize that the components may be assembled together and when so assembled provide for an operating power unit for a hydraulic floor jack. Prior art power units and hydraulic floor jacks are known in the art as set forth in U.S. Pat. No. 5,201,494 and US Patent Publication 2014/0326934 which are incorporated herein by reference.

Set forth below are details on features and qualities of key components that have been modified and improved to provide for enhanced performance and longevity. Each individual modification contributes to an overall performance and improvement with respect to the durability of the power unit. In combination, it has been further found that the life expectancy of a power unit 100 can be extended in excess of 10,000 cycles.

As seen in reference to FIG. 3, a ram assembly 5 is provided comprising a ram 5-1, a nylon backup ring 5-2, a ram bearing 5-3, a neoprene O-ring 5-4, a nylon backup ring 5-5, a polyurethane U-cup 5-6 and a retaining ring 5-7.

Ram 5-1 utilizes a 1045 steel which has been heat treated to an HRC value of about 30 to about 34. A 16 micro-finish is used on the surfaces with a chrome plating.

One end of the ram 5-1 supports a ram bearing 5-3. The ram bearing 5-3 utilizes a 1045 steel having a HRC value of between about 28 to about 32. A welded bronze coating is applied to the surface of the ram bearing 5-3 to provide for reduced friction and to minimize galling with adjacent sliding surfaces within the cylinder 6A.

The ram bearing 5-3 has placed within a defined groove a polyurethane U-cup seal 5-6 in which is adjacent a backup ring 5-5. The U-cup seal 5-6 has a shore A 95 hardness value. This high value has been found useful in providing greater durability for use with the adjacent surface within the manifold which is constructed of a material and process that is compatible with the hardness value and properties of the polyurethane seal 5-6.

Similarly, a 5-5 backup ring is provided of a durable nylon 1010 to provide improved shock absorbent and cushioning properties along with its sealing properties. As illustrated, a conventional snap ring 5-7 can be used to retain the ram bearing 5-3 and seals 5-6 and 5-5 unto a receiving end of ram 5-1.

Figure 4:
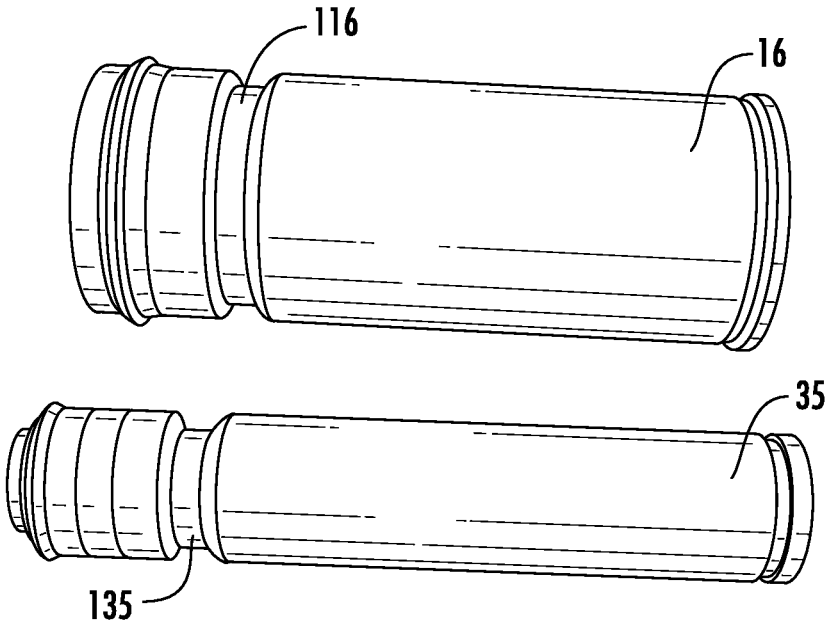
FIG. 4 is a perspective view of pressure pump pistons used in a hydraulic floor jack power unit.

As further seen in reference to FIG. 3 and FIG. 4, a low pressure pump piston 16 and a high pressure pump piston 35 are provided. Both pump piston 16 and 35 are fabricated from a 1045 steel and have HRC values of between about 34 to about 38. Both pump pistons further have a micro-finish with a value of 16 or lower. Additionally, both pump pistons have surfaces that are chrome plated.

Both pump pistons 16 and 35 define a respect lubricating groove 116 and 135 to allow adequate lubrication in view of the tight tolerances between the respective pump piston surfaces and the inner diameter of the respective pump housings 14 and 32. Polyurethane U-cup seals 15 and 33, having a shore A hardness value of 90 or greater, are fitted within the respective retaining grooves. The high pressure pump piston 35 further utilizes a backup ring 34 which is constructed of a nylon 1010.

The low pressure housing 14 and high pressure housing 32 are constructed of a 1045 steel having a HV 500 heat treatment. The respective housings also define inner diameters that have a ball broach finish and further having a 16 micro finish value. A black oxide coating is applied to an exterior of both housings 14 and 32 to provide for a rust inhibitor. An additional component that has been modified includes the cylinder bearing 3 which is used to secure the ram 5.1 within the cylinder 6A. Cylinder bearing 3 is provided by a 1040 CR steel material with a heat treatment to provide a HRC of between about 28 to about 32 and further having a micro-finish 32. A polyurethane O-ring 2 having a shore A hardness value of 90 is retained within the groove 103 defined within the interior of the cylinder bearing 3.

One additional modification includes the use of a polyurethane O-ring 29 which is secured to a threaded end of the release valve assembly 30. The use of a polyurethane seal at this location offers better temperature and pressure performance compared to conventional neoprene seals. O-ring seal 29 preferably has a shore A 90 hardness value. In addition, the other U-cup seals and O-ring seals illustrated in FIG. 3 and that are subjected to internal pressure of the power unit are also preferably made of a similar polyurethane for improved wear, temperature and pressure handling capabilities.

Figure 5:
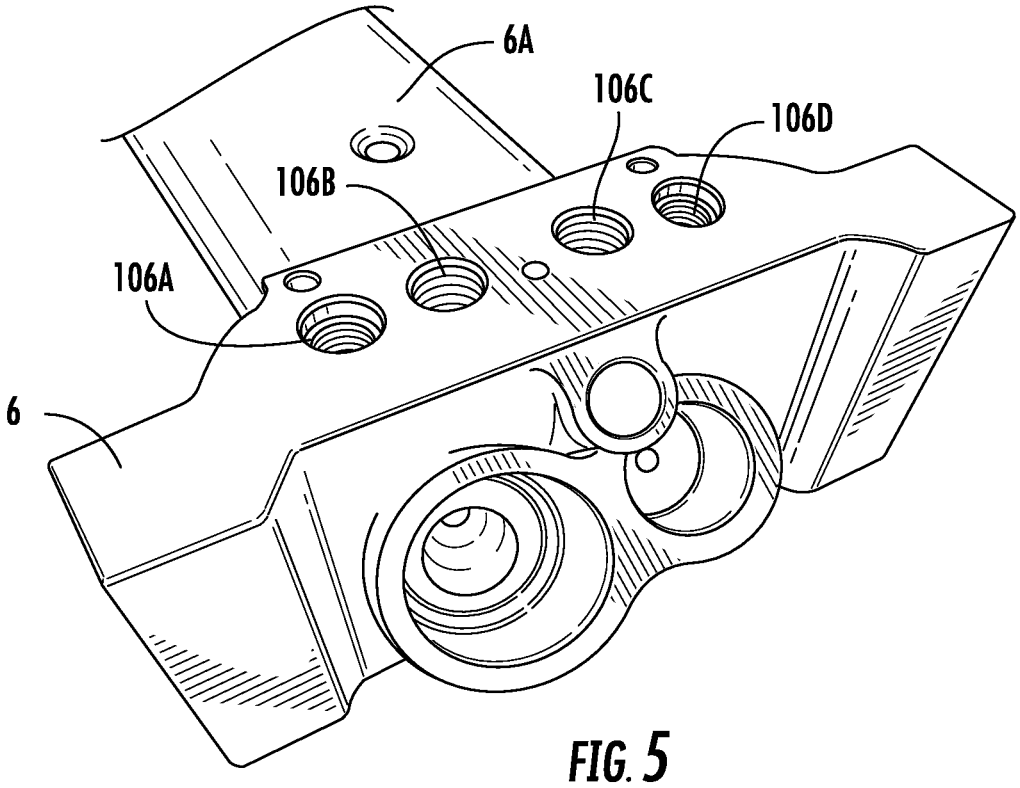
FIG. 5 is a manifold used in a power unit.
Figure 6:
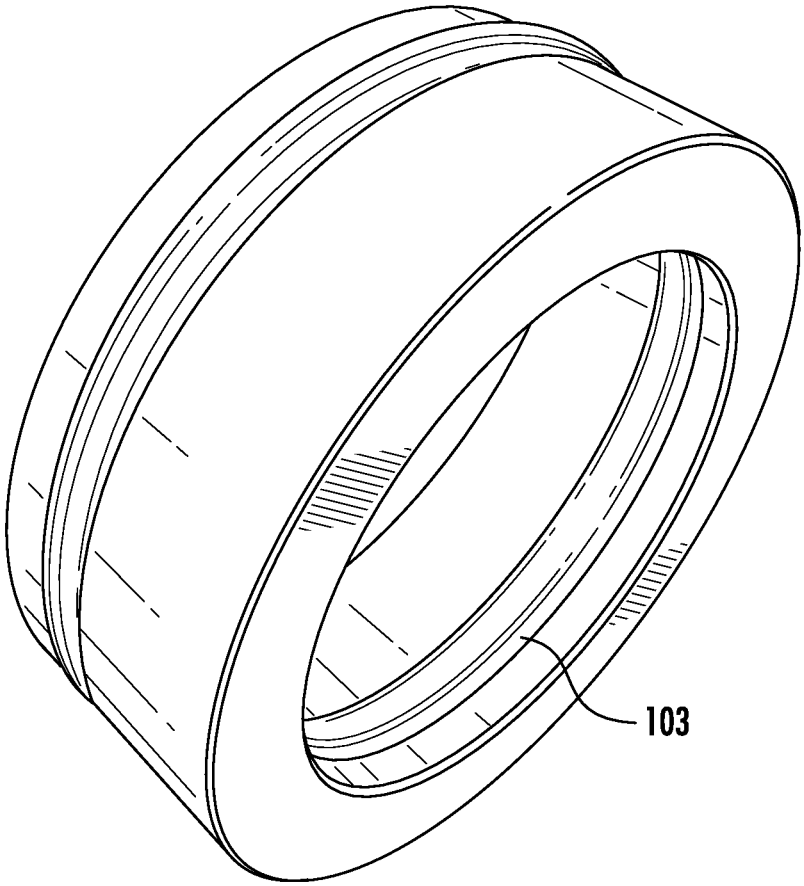
FIG. 6 is a perspective view of a cylinder bearing according to an embodiment of the invention.
Figure 7:
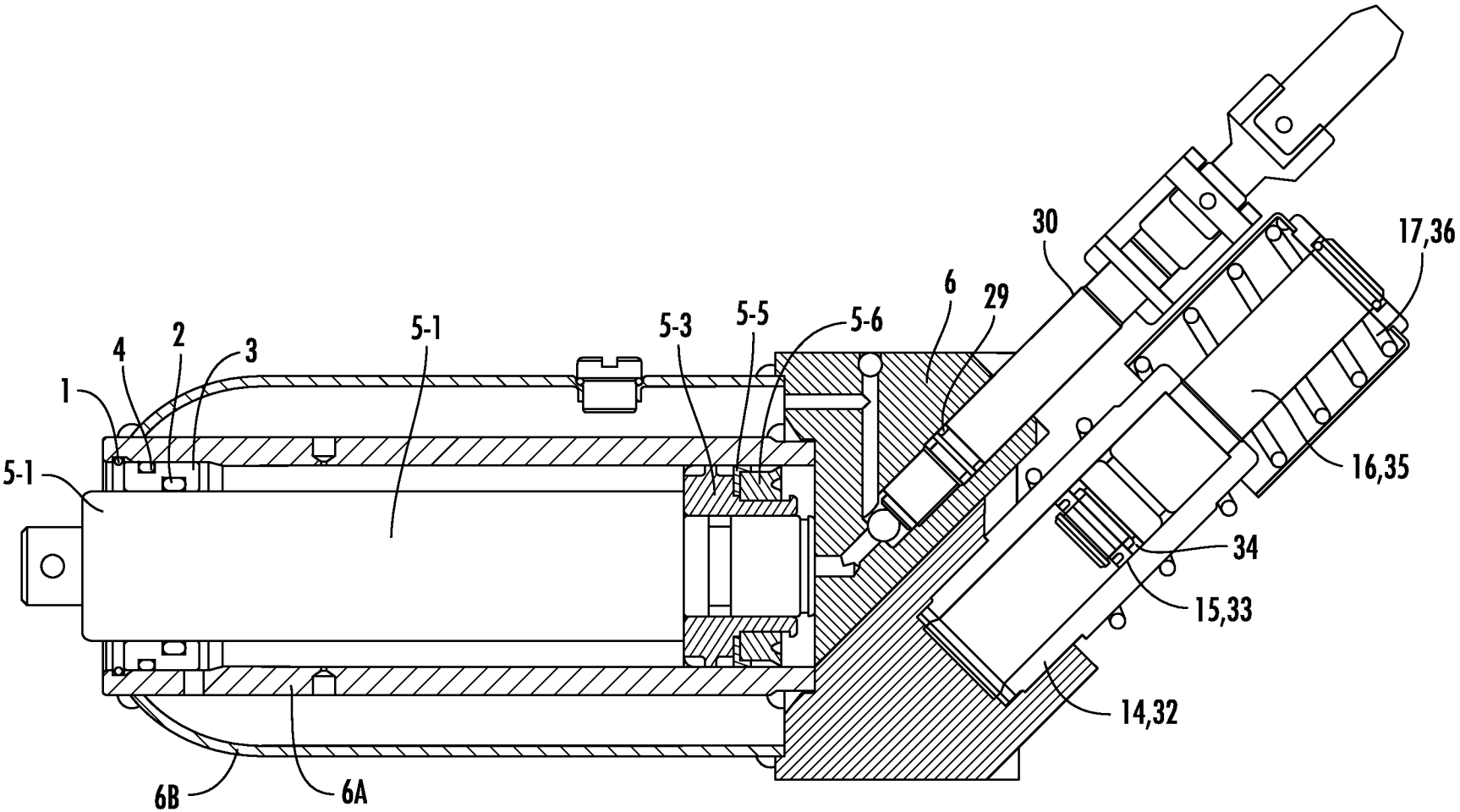
FIG. 7 is a cross sectional view of an hydraulic floor jack unit according to an embodiment of this invention.

As further seen in reference to FIGS. 3, 5 and 7, a uni-welded manifold 6 comprising a main cylinder 6A positioned within a reservoir 6B is utilized. Manifold 6 is constructed from a forged steel Q235. A forged steel component has been found to allow for a power unit to be constructed that has fewer impurities that are commonly found using a cast iron construction. Hydraulic fluid passed through a series of 50 full loading tests using a forged steel component had the hydraulic fluid removed and inspected. The coloration of the hydraulic fluid was close to the original, semi-transparent state. When virgin fluid was tested in a cast ductile iron power unit for a 50 times full loading test, the resulting hydraulic fluid was rendered dark black with metal impurities that were generated and released from the cast iron power unit. The ability to eliminate impurities associated with the component parts has been found to be important in establishing a power unit that provides for a longer operating life.

As best seen in FIG. 5, a series of ports 106A through 106D can be provided which simplifies the manufacturing process such that the drilling or tapping of the ports is done on a single surface as opposed to multiple sides or surfaces as more common with threaded constructions. As a result, the series of ports on the upper surface allows for an easier valve assembly and eliminates the need to disassemble components in order to access valves that are associated with prior art construction techniques. The uni-weld construction also provides for a more durable power unit by eliminating parts that can loosen over time and eliminating areas that require sealing and may subsequently leak.

In accordance with the present invention, it has also been found useful to utilize a quality of hydraulic fluid of Shell Tellus S2 M 22 that is not normally used in conventional professional floor jack power units. The hydraulic fluid has additives that prolong the life of the fluid, provides added lubricity and allows for a greater temperature range of operation. The hydraulic fluid also has anti-foaming and cleaning agents which contribute to the longevity of the power unit.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. An hydraulic power unit for a floor jack comprising:

a forged steel manifold welded to a reservoir, a cylinder in fluid communication with the reservoir, an upper surface of the manifold having a plurality of ports for receiving one or more check valves;

a ram assembly within the cylinder, the cylinder being constructed of 45 steel and a 32 micro finish, the ram assembly further comprising a ram having a material with HRC of between about 30 to about 34 and further having a 16 micro-finish, the ram assembly further comprising a ram bearing secured to a first end of the ram, the ram bearing having an external bronze coating, a micro-finish value of 32, and comprising a steel material with a HRC value of between about 28 to about 32, the ram bearing being in contact with a nylon 1010 seal, the nylon seal being in further communication with a U-cup seal of polyurethane, the U-cup seal having a shore A 95 hardness value.

2. The hydraulic power unit according to claim 1 wherein the ram is in communication on a second end with a cylinder bearing, the interior of the cylinder bearing having a micro-finish of 32.

3. The power unit according to claim 1 wherein a low pressure pump housing and a low pressure pump piston secured therein is in operative engagement and are further secured on one of said plurality of manifold ports.

4. A power unit according to claim 3 wherein an inner surface of the low pressure pump housing has a ball broach micro finish of 16.

5. The hydraulic power unit according to claim 3 wherein an inner surface of the low pressure pump housing has a ball broach micro finish of 16.

6. The power unit according to claim 3 wherein the low pressure pump housing further defines a black oxide outside coating.

7. The power unit according to claim 3 wherein the low pressure pump piston has an HRC value of between about 34 to about 38 and further defines a chrome plated micro finish of about 16.

8. The power unit according to claim 7 wherein the low pressure pump piston further defines a groove on an outer surface of the pump piston for lubrication purposes.

9. The power unit according to claim 1 wherein a high pressure pump housing and a high pressure pump piston secured therein are in operative engagement and are in further communication with one of said plurality of manifold ports.

10. The power unit according to claim 9 wherein an inner surface of the high pressure housing defines a surface having a 16 micro finish value.

11. The power unit according to claim 9 wherein the high pressure pump housing further includes a black oxide outside coating.

12. The power unit according to claim 9 wherein the high pressure pump piston has an HRC value of between about 34 to about 38 and further defines a chrome plated micro finish of about 16.

13. The power unit according to claim 12 wherein high pressure pump piston further defines a groove on an outer surface of the pump piston for lubrication purposes.

14. The power unit according to claim 1 wherein a cylinder bearing is used to secure the ram within the manifold cylinder, the manifold cylinder bearing having a HRC value of between about 28 to about 32 and further defining a micro finish of 32.

15. The power unit according to claim 14 wherein the cylinder bearing further defines a groove on an inner surface of the cylinder bearing, the groove including a polyurethane O-ring having a shore A hardness of about 90 the O-ring preventing pressurized hydraulic fluid from flowing pass the cylinder bearing.

16. The power unit according to claim 14 wherein the ram bearing further defines a groove on an outer surface of the ram bearing, the groove including a polyurethane U-cup seal and a nylon back up ring, the U-cup seal and nylon backup ring preventing pressurized hydraulic fluid from movement past the ram bearing.

17. An hydraulic power unit for a floor jack comprising:

a forged steel manifold welded to a reservoir, a cylinder in fluid communication with the reservoir, an upper surface of the manifold having a plurality of ports for receiving one or more check valves;

a ram assembly in operative engagement with the cylinder, the ram assembly further comprising a ram assembly bearing secured to a first end of the ram, the ram bearing having a exterior surface comprising a welded bronze coating, the exterior surface having a HRC value of between about 28 to about 32 and a micro finish value of 32; and the ram is in communication on a second end with a cylinder bearing, the interior of the cylinder bearing having a micro-finish of 32.

18. The power unit according to claim 17 further comprising a plurality of ports defined on an upper surface of the manifold.

19. The power unit according to claim 18 wherein the plurality of ports includes at least one port in further communication with a pressure release valve.

* * * * *